US008513169B2

(12) United States Patent
Diggs et al.

(10) Patent No.: US 8,513,169 B2
(45) Date of Patent: Aug. 20, 2013

(54) LUBRICATING OIL COMPOSITIONS

(75) Inventors: Nancy Z. Diggs, Westfield, NJ (US); Jose A. Gutierrez, Fanwood, NJ (US); Michael L. Alessi, Bedminster, NJ (US)

(73) Assignee: Infineum International Limited (GB)

( * ) Notice: Subject to any disclaimer, the term of this patent is extended or adjusted under 35 U.S.C. 154(b) by 690 days.

(21) Appl. No.: 11/488,585

(22) Filed: Jul. 18, 2006

(65) Prior Publication Data

US 2008/0020955 A1 Jan. 24, 2008

(51) Int. Cl.
*C10M 159/20* (2006.01)

(52) U.S. Cl.
USPC ..... 508/110; 508/154; 508/460; 508/545

(58) Field of Classification Search
USPC ..... 508/460, 545
See application file for complete search history.

(56) References Cited

U.S. PATENT DOCUMENTS

| | | | | |
|---|---|---|---|---|
| 6,114,288 | A | 9/2000 | Fujitsu et al. | 508/371 |
| 6,855,675 | B1 | 2/2005 | Yamada et al. | 508/365 |
| 7,026,273 | B2 | 4/2006 | Robson et al. | 508/156 |
| 2004/0224858 | A1 * | 11/2004 | Esche | 508/291 |
| 2005/0119138 | A1 * | 6/2005 | Ritchie et al. | 508/545 |
| 2006/0116299 | A1 | 6/2006 | Arrowsmith et al. | |
| 2006/0116300 | A1 * | 6/2006 | Arrowsmith et al. | 508/443 |

FOREIGN PATENT DOCUMENTS

| | | | |
|---|---|---|---|
| EP | 1167497 | A2 | 1/2002 |
| EP | 1 310 549 | B1 | 5/2006 |

* cited by examiner

*Primary Examiner* — Taiwo Oladapo

(57) ABSTRACT

A lubricating oil composition, more specifically a lubricating oil composition for heavy duty diesel (HDD) engines having a sulfated ash content of no greater than 1.0 mass %, such as from about 0.7 to 1.0 mass %, a sulfur content of no greater than 0.4 mass %, and a phosphorus content of no greater than 0.12 mass % (1200 ppm), such as from about 0.08 to 0.12 mass %; and a TBN of from about 7 to about 15, which lubricating oil composition includes a major amount of oil of lubricating viscosity, at least about 0.5 mass % of an ashless antioxidant selected from sulfur-free phenolic antioxidants, aminic antioxidants, and mixtures thereof, and a minor amount of overbased metal detergent, wherein at least about 60% of the TBN contributed to the lubricating oil composition by overbased detergent is contributed by overbased magnesium detergent.

18 Claims, No Drawings

LUBRICATING OIL COMPOSITIONS

The present invention relates to lubricating oil compositions. More specifically, the present invention is directed to lubricating oil compositions that provide improved lubricant performance in modern compression-ignited (diesel) engines, more specifically, modern heavy duty diesel (HDD) engines.

BACKGROUND OF THE INVENTION

Environmental concerns have led to continued efforts to reduce the $NO_x$ emissions of compression ignited (diesel) internal combustion engines. The latest technology being used to reduce the $NO_x$ emissions of diesel engines is known as exhaust gas recirculation or EGR. EGR reduces $NO_x$ emissions by introducing non-combustible components (exhaust gas) into the incoming air-fuel charge introduced into the engine combustion chamber. This reduces peak flame temperature and $NO_x$ generation. In addition to the simple dilution effect of the EGR, an even greater reduction in $NO_x$ emission is achieved by cooling the exhaust gas before it is returned to the engine. The cooler intake charge allows better filling of the cylinder, and thus, improved power generation. In addition, because the EGR components have higher specific heat values than the incoming air and fuel mixture, the EGR gas further cools the combustion mixture leading to greater power generation and better fuel economy at a fixed $NO_x$ generation level.

Diesel fuel contains sulfur. Even "low-sulfur" diesel fuel contains 300 to 400 ppm of sulfur. When the fuel is burned in the engine, this sulfur is converted to $SO_x$. In addition, one of the major by-products of the combustion of a hydrocarbon fuel is water vapor. Therefore, the exhaust stream contains some level of $NO_x$, $SO_x$ and water vapor. In the past, the presence of these substances has not been problematic because the exhaust gases remained extremely hot, and these components were exhausted in a disassociated, gaseous state. However, when the engine is equipped with an EGR system and the exhaust gas is mixed with cooler intake air and recirculated through the engine, the water vapor can condense and react with the $NO_x$ and $SO_x$ components to form a mist of nitric and sulfuric acids in the EGR stream. This phenomenon is further exacerbated when the EGR stream is cooled before it is returned to the engine.

From the foregoing, it is clear that lubricants for modern heavy duty diesel engines must be able to provide proper performance in a particularly harsh environment.

Concurrent with the development of the condensed EGR engine, there has been a continued effort to reduce the content of sulfated ash, phosphorus and sulfur in the crankcase lubricant due to both environmental concerns and to insure compatibility with pollution control devices used in combination with modern engines (e.g., three-way catalytic converters and particulate traps). A particularly effective class of antioxidant-antiwear additives available to lubricant formulators is metal salts of dialkyldithiophosphates, particularly zinc salts thereof, commonly referred to as ZDDP. While such additives provide excellent performance, ZDDP contributes each of sulfated ash, phosphorus and sulfur to lubricants. The most recent lubricant specifications in each of Europe (ACEA E6) and the United States (API CJ-4 (or PC-10)) require reductions in allowable levels of sulfated ash, phosphorus and sulfur relative to the prior standard, and have required reductions in the amount of ZDDP that can be used. Where reduced amounts of ZDDP are employed, alternative means of providing engine wear protection must be identified, preferably means that do not cause introduction of additional sulfated ash into the lubricant.

Surprisingly, it has been found that lubricating oil compositions employing certain select detergents exhibit excellent antiwear performance in diesel engines, including heavy duty diesel engines provided with EGR systems, using reduced levels of ZDDP.

SUMMARY OF THE INVENTION

In accordance with a first aspect of the invention, there is provided a lubricating oil composition, more specifically a lubricating oil composition for heavy duty diesel (HDD) engines having a sulfated ash content of no greater than 1.0 mass %, such as from about 0.7 to 1.0 mass %, a sulfur content of no greater than 0.4 mass %, and a phosphorus content of no greater than 0.12 mass % (1200 ppm), such as from about 0.08 to 0.12 mass %; and a TBN of from about 7 to about 15, which lubricating oil composition comprises a major amount of oil of lubricating viscosity, at least about 0.5 mass % of an ashless antioxidant selected from the group consisting of sulfur-free phenolic antioxidants, aminic antioxidants, and mixtures thereof, and a minor amount of overbased metal detergent, wherein at least about 60%, preferably at least about 80%, more preferably substantially all or all TBN contributed to the lubricating oil composition by overbased metal (ash-containing) detergent is contributed by overbased magnesium detergent.

In accordance with a second aspect of the invention, there is provided a lubricating oil composition, as described in the first aspect, wherein magnesium detergent is used in an amount providing said composition with at least 0.07 mass % (700 ppm), preferably at least 0.11 mass % (1100 ppm), more preferably at least 0.12 mass % (1200 ppm) of magnesium.

In accordance with a third aspect of the invention, there is provided a lubricating oil composition, as described in the first or second aspect, further comprising a nitrogen-containing dispersant in an amount providing the lubricating oil composition with at least 0.08 mass % of nitrogen.

In accordance with a fourth aspect of the invention, there is provided a lubricating oil composition, as described in the first, second or third aspect, substantially free, preferably free of molybdenum and boron.

In accordance with a fifth aspect of the invention, there is provided a lubricating oil composition, as described in the first through fourth aspects, comprising at least 0.6 mass %, preferably at least 0.8 mass %, more preferably at least 1.0 mass % of at least one ashless antioxidant selected from sulfur-free hindered phenol antioxidants, aminic antioxidants, and combinations thereof.

In accordance with a sixth aspect of the invention, there is provided a compression-ignited (diesel) engine, preferably a heavy duty diesel (HDD) engine, most preferably a heavy duty diesel engine equipped with at least one of an exhaust gas recirculation (EGR) system, a catalytic converter and a particulate trap, lubricated with a lubricating oil composition as described in any of the first through fifth aspects.

In accordance with a seventh aspect of the invention, there is provided a method for improving the wear performance, more particularly the valve train wear performance, of a compression-ignited (diesel) engine, preferably a heavy duty diesel (HDD) engine, more preferably a heavy duty diesel engine equipped with at least one of an exhaust gas recirculation (EGR) system, a catalytic converter and a particulate trap, which method comprises the steps of lubricating the engine with a lubricating oil composition as described in any of the first through fifth aspects, and operating the lubricated engine.

In accordance with a eighth aspect of the invention, there is provided the use of a lubricating oil composition as described in any of the first through fifth aspects to improve the wear performance, more particularly the valve train wear performance, of a compression-ignited (diesel) engine, preferably a heavy duty diesel (HDD) engine, more preferably a heavy duty diesel engine equipped with at least one of an exhaust gas recirculation (EGR) system, a catalytic converter and a particulate trap.

Other and further objects, advantages and features of the present invention will be understood by reference to the following specification.

DETAILED DESCRIPTION OF THE INVENTION

The oil of lubricating viscosity useful in the practice of the invention may range in viscosity from light distillate mineral oils to heavy lubricating oils such as gasoline engine oils, mineral lubricating oils and heavy duty diesel oils. Generally, the viscosity of the oil ranges from about 2 $mm^2$/sec (centistokes) to about 40 $mm^2$/sec, especially from about 3 $mm^2$/sec to about 20 $mm^2$/sec, most preferably from about 9 $mm^2$/sec to about 17 $mm^2$/sec, measured at 100° C.

Natural oils include animal oils and vegetable oils (e.g., castor oil, lard oil); liquid petroleum oils and hydrorefined, solvent-treated or acid-treated mineral oils of the paraffinic, naphthenic and mixed paraffinic-naphthenic types. Oils of lubricating viscosity derived from coal or shale also serve as useful base oils.

Synthetic lubricating oils include hydrocarbon oils and halo-substituted hydrocarbon oils such as polymerized and interpolymerized olefins (e.g., polybutylenes, polypropylenes, propylene-isobutylene copolymers, chlorinated polybutylenes, poly(1-hexenes), poly(1-octenes), poly(1-decenes)); alkylbenzenes (e.g., dodecylbenzenes, tetradecylbenzenes, dinonylbenzenes, di(2-ethylhexyl)benzenes); polyphenyls (e.g., biphenyls, terphenyls, alkylated polyphenols); and alkylated diphenyl ethers and alkylated diphenyl sulfides and derivative, analogs and homologs thereof.

Alkylene oxide polymers and interpolymers and derivatives thereof where the terminal hydroxyl groups have been modified by esterification, etherification, etc., constitute another class of known synthetic lubricating oils. These are exemplified by polyoxyalkylene polymers prepared by polymerization of ethylene oxide or propylene oxide, and the alkyl and aryl ethers of polyoxyalkylene polymers (e.g., methyl-polyiso-propylene glycol ether having a molecular weight of 1000 or diphenyl ether of poly-ethylene glycol having a molecular weight of 1000 to 1500); and mono- and polycarboxylic esters thereof, for example, the acetic acid esters, mixed $C_3$-$C_8$ fatty acid esters and $C_{13}$ Oxo acid diester of tetraethylene glycol.

Another suitable class of synthetic lubricating oils comprises the esters of dicarboxylic acids (e.g., phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids) with a variety of alcohols (e.g., butyl alcohol, hexyl alcohol, dodecyl alcohol, 2-ethylhexyl alcohol, ethylene glycol, diethylene glycol monoether, propylene glycol). Specific examples of such esters includes dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid. Also useful are synthetic oils derived from a gas to liquid process from Fischer-Tropsch synthesized hydrocarbons, which are commonly referred to as gas to liquid, or "GTL" base oils.

Esters useful as synthetic oils also include those made from $C_5$ to $C_{12}$ monocarboxylic acids and polyols and polyol esters such as neopentyl glycol, trimethylolpropane, pentaerythritol, dipentaerythritol and tripentaerythritol.

Silicon-based oils such as the polyalkyl-, polyaryl-, polyalkoxy- or polyaryloxysilicone oils and silicate oils comprise another useful class of synthetic lubricants; such oils include tetraethyl silicate, tetraisopropyl silicate, tetra-(2-ethylhexyl) silicate, tetra-(4-methyl-2-ethylhexyl)silicate, tetra-(p-tert-butyl-phenyl)silicate, hexa-(4-methyl-2-ethylhexyl)disiloxane, poly(methyl)siloxanes and poly(methylphenyl) siloxanes. Other synthetic lubricating oils include liquid esters of phosphorous-containing acids (e.g., tricresyl phosphate, trioctyl phosphate, diethyl ester of decylphosphonic acid) and polymeric tetrahydrofurans.

The oil of lubricating viscosity may comprise a Group I, Group II, Group III, Group IV or Group V base stocks or base oil blends of the aforementioned base stocks. Preferably, the oil of lubricating viscosity is a Group II, Group III, Group IV or Group V base stock, or a mixture thereof, or a mixture of a Group I base stock and one or more a Group II, Group III, Group IV or Group V base stock. The base stock, or base stock blend preferably has a saturate content of at least 65%, more preferably at least 75%, such as at least 85%. Preferably, the base stock or base stock blend is a Group III or higher base stock or mixture thereof, or a mixture of a Group II base stock and a Group III or higher base stock or mixture thereof. Most preferably, the base stock, or base stock blend, has a saturate content of greater than 90%. Preferably, the oil or oil blend will have a sulfur content of less than 1 mass %, preferably less than 0.6 mass %, most preferably less than 0.4 mass %, such as less than 0.3 mass %. Group III base stock has been found to provide a wear credit relative to Group I base stock. Therefore, in one preferred embodiment, at least 30 mass %, preferably at least 50 mass %, more preferably at least 80 mass % of the oil of lubricating viscosity used in lubricating oil compositions of the present invention is Group 3 base stock.

Preferably the volatility of the oil or oil blend, as measured by the Noack test (ASTM D5800), is less than or equal to 30 mass %, such as less than about 25 mass %, preferably less than or equal to 20 mass %, more preferably less than or equal to 15 mass %, most preferably less than or equal 13 mass %. Preferably, the viscosity index (VI) of the oil or oil blend is at least 85, preferably at least 100, most preferably from about 105 to 140.

Definitions for the base stocks and base oils in this invention are the same as those found in the American Petroleum Institute (API) publication "Engine Oil Licensing and Certification System", Industry Services Department, Fourteenth Edition, December 1996, Addendum 1, December 1998. Said publication categorizes base stocks as follows:

a) Group I base stocks contain less than 90 percent saturates and/or greater than 0.03 percent sulfur and have a viscosity index greater than or equal to 80 and less than 120 using the test methods specified in Table 1.

b) Group II base stocks contain greater than or equal to 90 percent saturates and less than or equal to 0.03 percent sulfur and have a viscosity index greater than or equal to 80 and less than 120 using the test methods specified in Table 1.

c) Group III base stocks contain greater than or equal to 90 percent saturates and less than or equal to 0.03 percent sulfur and have a viscosity index greater than or equal to 120 using the test methods specified in Table 1.

d) Group IV base stocks are polyalphaolefins (PAO).

e) Group V base stocks include all other base stocks not included in Group I, II, III, or IV.

TABLE 1

Analytical Methods for Base Stock

| Property | Test Method |
|---|---|
| Saturates | ASTM D 2007 |
| Viscosity Index | ASTM D 2270 |
| Sulfur | ASTM D 2622; ASTM D 4294; ASTM D 4927; ASTM D 3120 |

Metal-containing or ash-forming detergents function as both detergents to reduce or remove deposits and as acid neutralizers or rust inhibitors, thereby reducing wear and corrosion and extending engine life. Detergents generally comprise a polar head with a long hydrophobic tail. The polar head comprises a metal salt of an acidic organic compound. The salts may contain a substantially stoichiometric amount of the metal in which case they are usually described as normal or neutral salts, and have a total base number or TBN (as can be measured by ASTM D2896) of from 0 to less than 150, such as 0 to about 80 or 100. A large amount of a metal base may be incorporated by reacting excess metal compound (e.g., an oxide or hydroxide) with an acidic gas (e.g., carbon dioxide). The resulting overbased detergent comprises neutralized detergent as the outer layer of a metal base (e.g. carbonate) micelle. Such overbased detergents have a TBN of 150 or greater, and typically will have a TBN of from 250 to 450 or more.

Detergents that may be used include oil-soluble neutral and overbased sulfonates, phenates, sulfurized phenates, thiophosphonates, salicylates, and naphthenates and other oil-soluble carboxylates of a metal, particularly the alkali or alkaline earth metals, e.g., barium, sodium, potassium, lithium, calcium, and magnesium. The most commonly used metals are calcium and magnesium, which may both be present in detergents used in a lubricant, and mixtures of calcium and/or magnesium with sodium. Combinations of detergents, whether overbased or neutral or both, may be used.

Sulfonates may be prepared from sulfonic acids which are typically obtained by the sulfonation of alkyl substituted aromatic hydrocarbons such as those obtained from the fractionation of petroleum or by the alkylation of aromatic hydrocarbons. Examples included those obtained by alkylating benzene, toluene, xylene, naphthalene, diphenyl or their halogen derivatives such as chlorobenzene, chlorotoluene and chloronaphthalene. The alkylation may be carried out in the presence of a catalyst with alkylating agents having from about 3 to more than 70 carbon atoms. The alkaryl sulfonates usually contain from about 9 to about 80 or more carbon atoms, preferably from about 16 to about 60 carbon atoms per alkyl substituted aromatic moiety.

The oil soluble sulfonates or alkaryl sulfonic acids may be neutralized with oxides, hydroxides, alkoxides, carbonates, carboxylate, sulfides, hydrosulfides, nitrates, borates and ethers of the metal. The amount of metal compound is chosen having regard to the desired TBN of the final product but typically ranges from about 100 to 220 mass % (preferably at least 125 mass %) of that stoichiometrically required.

Metal salts of phenols and sulfurized phenols are prepared by reaction with an appropriate metal compound such as an oxide or hydroxide and neutral or overbased products may be obtained by methods well known in the art. Sulfurized phenols may be prepared by reacting a phenol with sulfur or a sulfur containing compound such as hydrogen sulfide, sulfur monohalide or sulfur dihalide, to form products which are generally mixtures of compounds in which 2 or more phenols are bridged by sulfur containing bridges.

Carboxylate detergents, e.g., salicylates, can be prepared by reacting an aromatic carboxylic acid with an appropriate metal compound such as an oxide or hydroxide and neutral or overbased products may be obtained by methods well known in the art. The aromatic moiety of the aromatic carboxylic acid can contain hetero atoms, such as nitrogen and oxygen. Preferably, the moiety contains only carbon atoms; more preferably the moiety contains six or more carbon atoms; for example benzene is a preferred moiety. The aromatic carboxylic acid may contain one or more aromatic moieties, such as one or more benzene rings, either fused or connected via alkylene bridges. The carboxylic moiety may be attached directly or indirectly to the aromatic moiety. Preferably the carboxylic acid group is attached directly to a carbon atom on the aromatic moiety, such as a carbon atom on the benzene ring. More preferably, the aromatic moiety also contains a second functional group, such as a hydroxy group or a sulfonate group, which can be attached directly or indirectly to a carbon atom on the aromatic moiety.

Preferred examples of aromatic carboxylic acids are salicylic acids and sulfurized derivatives thereof, such as hydrocarbyl substituted salicylic acid and derivatives thereof. Processes for sulfurizing, for example a hydrocarbyl-substituted salicylic acid, are known to those skilled in the art. Salicylic acids are typically prepared by carboxylation, for example, by the Kolbe-Schmitt process, of phenoxides, and in that case, will generally be obtained, normally in a diluent, in admixture with uncarboxylated phenol.

Preferred substituents in oil-soluble salicylic acids are alkyl substituents. In alkyl-substituted salicylic acids, the alkyl groups advantageously contain 5 to 100, preferably 9 to 30, especially 14 to 20, carbon atoms. Where there is more than one alkyl group, the average number of carbon atoms in all of the alkyl groups is preferably at least 9 to ensure adequate oil solubility.

Detergents generally useful in the formulation of lubricating oil compositions also include "hybrid" detergents formed with mixed surfactant systems, e.g., phenate/salicylates, sulfonate/phenates, sulfonate/salicylates, sulfonates/phenates/salicylates, as described, for example, in U.S. Pat. Nos. 6,153,565; 6,281,179; 6,429,178; and 6,429,178.

Lubricating oil compositions of the present invention contain overbased metal detergent, consisting essentially of overbased magnesium detergent. Overbased magnesium detergent is preferably used in an amount providing said composition with at least 0.07 mass % (700 ppm), preferably at least 0.11 mass % (1100 ppm), more preferably at least 0.12 mass % (1200 ppm) of magnesium. Overbased detergent is preferably used in an amount providing the lubricating oil composition with a TBN of from about 5 to about 12, preferably from about 5.3 to about 10, more preferably from about 5.7 to about 9. Overbased ash-containing detergents based on metals other than magnesium are present in amounts contributing no greater than 40% of the TBN of the lubricating oil composition contributed by overbased detergent. Preferably, lubricating oil compositions of the present invention contain overbased ash-containing detergents based on metals other than magnesium in amounts providing no greater than about 20% of the total TBN contributed to the lubricating oil composition by overbased detergent. Combinations of overbased magnesium detergents may be used (e.g., an overbased magnesium salicylate and an overbased magnesium sulfonate; or two or more magnesium detergents each having a different TBN of greater than 150). Preferably, the overbased magnesium detergent will have, or have on average, a TBN of at least about 200, such as from about 200 to about 500; preferably at least about 250, such as from about 250 to about 500; more preferably at least about 300, such as from about 300 to about 450.

In addition to the required overbased magnesium detergent, lubricating oil compositions may contain neutral metal-containing detergents (having a TBN of less than 150). These neutral metal-based detergents may be magnesium salts or salts of other alkali or alkali earth metals, such as calcium. Where neutral detergents based on metals other than magnesium are employed, preferably at least about 40 mass %, more preferably at least about 59 mass %, particularly at least about 70 mass % of the total amount of metal introduced into the lubricating oil composition by detergent will be magnesium.

Lubricating oil compositions of the present invention may also contain ashless (metal-free) detergents such as oil-soluble hydrocarbyl phenol aldehyde condensates described, for example, in US-2005-0277559-A1.

Preferably, detergent in total is used in an amount providing the lubricating oil composition with from about 0.35 to about 1.0 mass %, such as from about 0.5 to about 0.9 mass %, more preferably from about 0.6 to about 0.8 mass % of sulfated ash (SASH). Preferably, the lubricating oil composition has a TBN of from about 7 to about 15, such as from about 8 to about 13, more preferably from about 9 to about 11. TBN may be contributed to the lubricating oil composition by additives other than detergents. Dispersants, antioxidants and antiwear agents may in some cases contribute 40% or more of the total amount of lubricant TBN.

Conventionally, lubricating oil compositions formulated for use in a heavy duty diesel engine comprise from about 0.5 to about 10 mass %, preferably from about 1.5 to about 5 mass %, most preferably from about 2 to about 3 mass % of detergent, based on the total mass of the formulated lubricating oil composition. Detergents are conventionally formed in diluent oil. Conventionally, detergents are referred to by the TBN, which is the TBN of the active detergent in the diluent. Therefore, while other additives are often referred to in terms of the amount of active ingredient (A.I.), stated amounts of detergent refer to the total mass of detergent including diluent.

Dihydrocarbyl dithiophosphate metal salts are frequently used as antiwear and antioxidant agents. The metal may be an alkali or alkaline earth metal, or aluminum, lead, tin, molybdenum, manganese, nickel or copper. The zinc salts are most commonly used in lubricating oil in amounts of 0.1 to 10, preferably 0.2 to 2 mass %, based upon the total weight of the lubricating oil composition. They may be prepared in accordance with known techniques by first forming a dihydrocarbyl dithiophosphoric acid (DDPA), usually by reaction of one or more alcohol or a phenol with $P_2S_5$ and then neutralizing the formed DDPA with a zinc compound. For example, a dithiophosphoric acid may be made by reacting mixtures of primary and secondary alcohols. Alternatively, multiple dithiophosphoric acids can be prepared where the hydrocarbyl groups on one are entirely secondary in character and the hydrocarbyl groups on the others are entirely primary in character. To make the zinc salt, any basic or neutral zinc compound could be used but the oxides, hydroxides and carbonates are most generally employed. Commercial additives frequently contain an excess of zinc due to the use of an excess of the basic zinc compound in the neutralization reaction.

The preferred zinc dihydrocarbyl dithiophosphates are oil soluble salts of dihydrocarbyl dithiophosphoric acids and may be represented by the following formula:

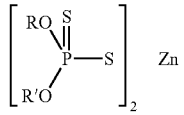

wherein R and R' may be the same or different hydrocarbyl radicals containing from 1 to 18, preferably 2 to 12, carbon atoms and including radicals such as alkyl, alkenyl, aryl, arylalkyl, alkaryl and cycloaliphatic radicals. Particularly preferred as R and R' groups are alkyl groups of 2 to 8 carbon atoms. Thus, the radicals may, for example, be ethyl, n-propyl, i-propyl, n-butyl, i-butyl, sec-butyl, amyl, n-hexyl, i-hexyl, n-octyl, decyl, dodecyl, octadecyl, 2-ethylhexyl, phenyl, butylphenyl, cyclohexyl, methylcyclopentyl, propenyl, butenyl. In order to obtain oil solubility, the total number of carbon atoms (i.e. R and R') in the dithiophosphoric acid will generally be about 5 or greater. The zinc dihydrocarbyl dithiophosphate (ZDDP) can therefore comprise zinc dialkyl dithiophosphates. Lubricating oil compositions of the present invention have a phosphorous content of no greater than about 0.12 mass % (1200 ppm). Conventionally, ZDDP is used in an amount close or equal to the maximum amount allowed. Thus, lubricating oil compositions in accordance with the present invention, formulated for use in heavy duty diesel engines, will preferably contain ZDDP or other metal salt of a dihydrocarbyl dithiophosphate, in an amount introducing from about 0.08 to about 0.12 mass % of phosphorus, based on the total mass of the lubricating oil composition. Preferably, ZDDP is the sole phosphorus-containing additive present.

Oxidation inhibitors or antioxidants reduce the tendency of mineral oils to deteriorate in service. Oxidative deterioration can be evidenced by sludge in the lubricant, varnish-like deposits on the metal surfaces, and by viscosity growth. Such oxidation inhibitors include hindered phenols, alkaline earth metal salts of alkylphenolthioesters having preferably $C_5$ to $C_{12}$ alkyl side chains, calcium nonylphenol sulfide, oil soluble phenates and sulfurized phenates, phosphosulfurized or sulfurized hydrocarbons or esters, phosphorous esters, metal thiocarbamates, oil soluble copper compounds as described in U.S. Pat. No. 4,867,890, and molybdenum-containing compounds.

Aromatic amines having at least two aromatic groups attached directly to the nitrogen constitute another class of compounds that is frequently used for antioxidancy. Typical oil soluble aromatic amines having at least two aromatic groups attached directly to one amine nitrogen contain from 6 to 16 carbon atoms. The amines may contain more than two aromatic groups. Compounds having a total of at least three aromatic groups in which two aromatic groups are linked by a covalent bond or by an atom or group (e.g., an oxygen or sulfur atom, or a —CO—, —$SO_2$— or alkylene group) and two are directly attached to one amine nitrogen also considered aromatic amines having at least two aromatic groups attached directly to the nitrogen. The aromatic rings are typically substituted by one or more substituents selected from alkyl, cycloalkyl, alkoxy, aryloxy, acyl, acylamino, hydroxy, and nitro groups. The amount of any such oil soluble aromatic amines having at least two aromatic groups attached directly to one amine nitrogen should preferably not exceed 0.4 mass %.

The antiwear agent ZDDP provides a strong antioxidant credit to lubricants. When less ZDDP is used in order to meet phosphorus and SASH limits, lubricant formulators must compensate for the resulting reduction in oxidation inhibition, preferably by use of highly effective, ashless, sulfur-free antioxidants. Lubricating oil compositions in accordance with the present invention therefore contain at least about 0.5 mass %, preferably at least about 0.6 mass %, such as at least 0.8 mass %, more preferably, at least 1.0 mass % of an ashless antioxidant selected from the group consisting of sulfur-free phenolic antioxidant, aminic antioxidant, or a combination thereof. Preferably, lubricating oil compositions in accordance with the present invention contain a combination of sulfur-free phenolic antioxidant and aminic antioxidant.

Dispersants maintain in suspension materials resulting from oxidation during use that are insoluble in oil, thus preventing sludge flocculation and precipitation, or deposition on metal parts. The lubricating oil composition of the present invention comprises at least one dispersant, and may comprise a plurality of dispersants. The dispersant or dispersants are preferably nitrogen-containing dispersants and preferably contribute, in total, from about 0.08 to about 0.19 mass %, such as from about 0.09 to about 0.18 mass %, most preferably from about 0.09 to about 0.16 mass % of nitrogen to the lubricating oil composition.

Dispersants useful in the context of the present invention include the range of nitrogen-containing, ashless (metal-free) dispersants known to be effective to reduce formation of deposits upon use in gasoline and diesel engines, when added to lubricating oils and comprise an oil soluble polymeric long chain backbone having functional groups capable of associating with particles to be dispersed. Typically, such dispersants have amine, amine-alcohol or amide polar moieties attached to the polymer backbone, often via a bridging group. The ashless dispersant may be, for example, selected from oil soluble salts, esters, amino-esters, amides, imides and oxazolines of long chain hydrocarbon-substituted mono- and polycarboxylic acids or anhydrides thereof; thiocarboxylate derivatives of long chain hydrocarbons; long chain aliphatic hydrocarbons having polyamine moieties attached directly thereto; and Mannich condensation products formed by condensing a long chain substituted phenol with formaldehyde and polyalkylene polyamine.

Generally, each mono- or dicarboxylic acid-producing moiety will react with a nucleophilic group (amine or amide) and the number of functional groups in the polyalkenyl-substituted carboxylic acylating agent will determine the number of nucleophilic groups in the finished dispersant.

The polyalkenyl moiety of the dispersant of the present invention has a number average molecular weight of from about 700 to about 3000, preferably between 950 and 3000, such as between 950 and 2800, more preferably from about 950 to 2500, and most preferably from about 950 to about 2400. In one embodiment of the invention, the dispersant comprises a combination of a lower molecular weight dispersant (e.g., having a number average molecular weight of from about 700 to 1100) and a high molecular weight dispersant having a number average molecular weight of from about at least about 1500, preferably between 1800 and 3000, such as between 2000 and 2800, more preferably from about 2100 to 2500, and most preferably from about 2150 to about 2400. The molecular weight of a dispersant is generally expressed in terms of the molecular weight of the polyalkenyl moiety as the precise molecular weight range of the dispersant depends on numerous parameters including the type of polymer used to derive the dispersant, the number of functional groups, and the type of nucleophilic group employed.

The polyalkenyl moiety from which the high molecular weight dispersants are derived preferably have a narrow molecular weight distribution (MWD), also referred to as polydispersity, as determined by the ratio of weight average molecular weight ($M_w$) to number average molecular weight ($M_n$). Specifically, polymers from which the dispersants of the present invention are derived have a $M_w/M_n$ of from about 1.5 to about 2.0, preferably from about 1.5 to about 1.9, most preferably from about 1.6 to about 1.8.

Suitable hydrocarbons or polymers employed in the formation of the dispersants of the present invention include homopolymers, interpolymers or lower molecular weight hydrocarbons. One family of such polymers comprise polymers of ethylene and/or at least one $C_3$ to $C_{28}$ alpha-olefin having the formula $H_2C{=}CHR^1$ wherein $R^1$ is straight or branched chain alkyl radical comprising 1 to 26 carbon atoms and wherein the polymer contains carbon-to-carbon unsaturation, preferably a high degree of terminal ethenylidene unsaturation. Preferably, such polymers comprise interpolymers of ethylene and at least one alpha-olefin of the above formula, wherein $R^1$ is alkyl of from 1 to 18 carbon atoms, and more preferably is alkyl of from 1 to 8 carbon atoms, and more preferably still of from 1 to 2 carbon atoms. Therefore, useful alpha-olefin monomers and comonomers include, for example, propylene, butene-1, hexene-1, octene-1,4-methylpentene-1, decene-1, dodecene-1, tridecene-1, tetradecene-1, pentadecene-1, hexadecene-1, heptadecene-1, octadecene-1, nonadecene-1, and mixtures thereof (e.g., mixtures of propylene and butene-1, and the like). Exemplary of such polymers are propylene homopolymers, butene-1 homopolymers, ethylene-propylene copolymers, ethylene-butene-1 copolymers, propylene-butene copolymers and the like, wherein the polymer contains at least some terminal and/or internal unsaturation. Preferred polymers are unsaturated copolymers of ethylene and propylene and ethylene and butene-1. The interpolymers of this invention may contain a minor amount, e.g. 0.5 to 5 mole % of a $C_4$ to $C_{18}$ non-conjugated diolefin comonomer. However, it is preferred that the polymers of this invention comprise only alpha-olefin homopolymers, interpolymers of alpha-olefin comonomers and interpolymers of ethylene and alpha-olefin comonomers. The molar ethylene content of the polymers employed in this invention is preferably in the range of 0 to 80%, and more preferably 0 to 60%. When propylene and/or butene-1 are employed as comonomer(s) with ethylene, the ethylene content of such copolymers is most preferably between 15 and 50%, although higher or lower ethylene contents may be present.

These polymers may be prepared by polymerizing alpha-olefin monomer, or mixtures of alpha-olefin monomers, or mixtures comprising ethylene and at least one $C_3$ to $C_{28}$ alpha-olefin monomer, in the presence of a catalyst system comprising at least one metallocene (e.g., a cyclopentadienyl-transition metal compound) and an alumoxane compound. Using this process, a polymer in which 95% or more of the polymer chains possess terminal ethenylidene-type unsaturation can be provided. The percentage of polymer chains exhibiting terminal ethenylidene unsaturation may be determined by FTIR spectroscopic analysis, titration, or $C^{13}$ NMR. Interpolymers of this latter type may be characterized by the formula $POLY{-}C(R^1){=}CH_2$ wherein $R^1$ is $C_1$ to $C_{26}$ alkyl, preferably $C_1$ to $C_{18}$ alkyl, more preferably $C_1$ to $C_8$ alkyl, and most preferably $C_1$ to $C_2$ alkyl, (e.g., methyl or ethyl) and wherein POLY represents the polymer chain. The chain length of the $R_1$ alkyl group will vary depending on the comonomer(s) selected for use in the polymerization. A minor amount of the polymer chains can contain terminal ethenyl, i.e., vinyl, unsaturation, i.e. POLY-CH=$CH_2$, and a portion of the polymers can contain internal monounsaturation, e.g. POLY-CH=CH($R^1$), wherein $R_1$ is as defined above. These terminally unsaturated interpolymers may be prepared by known metallocene chemistry and may also be prepared as described in U.S. Pat. Nos. 5,498,809; 5,663,130; 5,705,577; 5,814,715; 6,022,929 and 6,030,930.

Another useful class of polymers is polymers prepared by cationic polymerization of isobutene, styrene, and the like. Common polymers from this class include polyisobutenes obtained by polymerization of a $C_4$ refinery stream having a butene content of about 35 to about 75 mass %, and an isobutene content of about 30 to about 60 mass %, in the presence of a Lewis acid catalyst, such as aluminum trichloride or boron trifluoride. A preferred source of monomer for making poly-n-butenes is petroleum feedstreams such as Raffinate II. These feedstocks are disclosed in the art such as in U.S. Pat. No. 4,952,739. Polyisobutylene is a most preferred backbone of the present invention because it is readily available by cationic polymerization from butene streams (e.g., using $AlCl_3$ or $BF_3$ catalysts). Such polyisobutylenes generally contain residual unsaturation in amounts of about one ethylenic double bond per polymer chain, positioned along the chain. A preferred embodiment utilizes polyisobutylene prepared from a pure isobutylene stream or a Raffinate I stream to prepare reactive isobutylene polymers with terminal vinylidene olefins. Preferably, these polymers, referred to as highly reactive polyisobutylene (HR-PIB), have a terminal vinylidene content of at least 65%, e.g., 70%, more preferably at least 80%, most preferably, at least 85%. The preparation of such polymers is described, for example, in U.S. Pat. No. 4,152,499. HR-PIB is known and HR-PIB is commercially available under the tradenames Glissopa™ (from BASF) and Ultravis™ (from BP-Amoco).

Polyisobutylene polymers that may be employed are generally based on a hydrocarbon chain of from about 700 to 3000. Methods for making polyisobutylene are known. Polyisobutylene can be functionalized by halogenation (e.g. chlorination), the thermal "ene" reaction, or by free radical grafting using a catalyst (e.g. peroxide), as described below.

The hydrocarbon or polymer backbone can be functionalized, e.g., with carboxylic acid producing moieties (preferably acid or anhydride moieties) selectively at sites of carbon-to-carbon unsaturation on the polymer or hydrocarbon chains, or randomly along chains using any of the three processes mentioned above or combinations thereof, in any sequence.

Processes for reacting polymeric hydrocarbons with unsaturated carboxylic acids, anhydrides or esters and the preparation of derivatives from such compounds are disclosed in U.S. Pat. Nos. 3,087,936; 3,172,892; 3,215,707; 3,231,587; 3,272,746; 3,275,554; 3,381,022; 3,442,808; 3,565,804; 3,912,764; 4,110,349; 4,234,435; 5,777,025; 5,891,953; as well as EP 0 382450 B1; CA-1,335,895 and GB-A-1,440,219. The polymer or hydrocarbon may be functionalized, for example, with carboxylic acid producing moieties (preferably acid or anhydride) by reacting the polymer or hydrocarbon under conditions that result in the addition of functional moieties or agents, i.e., acid, anhydride, ester moieties, etc., onto the polymer or hydrocarbon chains primarily at sites of carbon-to-carbon unsaturation (also referred to as ethylenic or olefinic unsaturation) using the halogen assisted functionalization (e.g. chlorination) process or the thermal "ene" reaction.

Selective functionalization can be accomplished by halogenating, e.g., chlorinating or brominating the unsaturated α-olefin polymer to about 1 to 8 mass %, preferably 3 to 7 mass % chlorine, or bromine, based on the weight of polymer or hydrocarbon, by passing the chlorine or bromine through the polymer at a temperature of 60 to 250° C., preferably 110 to 160° C., e.g., 120 to 140° C., for about 0.5 to 10, preferably 1 to 7 hours. The halogenated polymer or hydrocarbon (hereinafter backbone) is then reacted with sufficient monounsaturated reactant capable of adding the required number of functional moieties to the backbone, e.g., monounsaturated carboxylic reactant, at 100 to 250° C., usually about 180° C. to 235° C., for about 0.5 to 10, e.g., 3 to 8 hours, such that the product obtained will contain the desired number of moles of the monounsaturated carboxylic reactant per mole of the halogenated backbones. Alternatively, the backbone and the monounsaturated carboxylic reactant are mixed and heated while adding chlorine to the hot material.

While chlorination normally helps increase the reactivity of starting olefin polymers with monounsaturated functionalizing reactant, it is not necessary with some of the polymers or hydrocarbons contemplated for use in the present invention, particularly those preferred polymers or hydrocarbons which possess a high terminal bond content and reactivity. Preferably, therefore, the backbone and the monounsaturated functionality reactant, e.g., carboxylic reactant, are contacted at elevated temperature to cause an initial thermal "ene" reaction to take place. Ene reactions are known.

The hydrocarbon or polymer backbone can be functionalized by random attachment of functional moieties along the polymer chains by a variety of methods. For example, the polymer, in solution or in solid form, may be grafted with the monounsaturated carboxylic reactant, as described above, in the presence of a free-radical initiator. When performed in solution, the grafting takes place at an elevated temperature in the range of about 100 to 260° C., preferably 120 to 240° C. Preferably, free-radical initiated grafting would be accomplished in a mineral lubricating oil solution containing, e.g., 1 to 50 mass %, preferably 5 to 30 mass % polymer based on the initial total oil solution.

The free-radical initiators that may be used are peroxides, hydroperoxides, and azo compounds, preferably those that have a boiling point greater than about 100° C. and decompose thermally within the grafting temperature range to provide free-radicals. Representative of these free-radical initiators are azobutyronitrile, 2,5-dimethylhex-3-ene-2,5-bis-tertiary-butyl peroxide and dicumene peroxide. The initiator, when used, typically is used in an amount of between 0.005% and 1% by weight based on the weight of the reaction mixture solution. Typically, the aforesaid monounsaturated carboxylic reactant material and free-radical initiator are used in a weight ratio range of from about 1.0:1 to 30:1, preferably 3:1 to 6:1. The grafting is preferably carried out in an inert atmosphere, such as under nitrogen blanketing. The resulting grafted polymer is characterized by having carboxylic acid (or ester or anhydride) moieties randomly attached along the polymer chains: it being understood, of course, that some of the polymer chains remain ungrafted. The free radical grafting described above can be used for the other polymers and hydrocarbons of the present invention.

The preferred monounsaturated reactants that are used to functionalize the backbone comprise mono- and dicarboxylic acid material, i.e., acid, anhydride, or acid ester material, including (i) monounsaturated $C_4$ to $C_{10}$ dicarboxylic acid wherein (a) the carboxyl groups are vicinyl, (i.e., located on adjacent carbon atoms) and (b) at least one, preferably both, of said adjacent carbon atoms are part of said mono unsaturation; (ii) derivatives of (i) such as anhydrides or $C_1$ to $C_5$ alcohol derived mono- or diesters of (i); (iii) monounsaturated $C_3$ to $C_{10}$ monocarboxylic acid wherein the carbon-carbon double bond is conjugated with the carboxy group, i.e., of the structure —C═C—CO—; and (iv) derivatives of (iii) such as $C_1$ to $C_5$ alcohol derived mono- or diesters of (iii). Mixtures of monounsaturated carboxylic materials (i)-(iv) also may be used. Upon reaction with the backbone, the monounsaturation of the monounsaturated carboxylic reactant becomes saturated. Thus, for example, maleic anhydride becomes backbone-substituted succinic anhydride, and acrylic acid becomes backbone-substituted propionic acid. Exemplary of such monounsaturated carboxylic reactants are fumaric acid, itaconic acid, maleic acid, maleic anhydride, chloromaleic acid, chloromaleic anhydride, acrylic acid, methacrylic acid, crotonic acid, cinnamic acid, and lower alkyl (e.g., $C_1$ to $C_4$ alkyl) acid esters of the foregoing, e.g., methyl maleate, ethyl fumarate, and methyl fumarate.

To provide the required functionality, the monounsaturated carboxylic reactant, preferably maleic anhydride, typically will be used in an amount ranging from about equimolar amount to about 100 mass % excess, preferably 5 to 50 mass % excess, based on the moles of polymer or hydrocarbon. Unreacted excess monounsaturated carboxylic reactant can be removed from the final dispersant product by, for example, stripping, usually under vacuum, if required.

The functionalized oil-soluble polymeric hydrocarbon backbone is then derivatized with a nitrogen-containing nucleophilic reactant, such as an amine, amino-alcohol, amide, or mixture thereof, to form a corresponding derivative. Amine compounds are preferred. Useful amine compounds for derivatizing functionalized polymers comprise at least one amine and can comprise one or more additional amine or other reactive or polar groups. These amines may be hydrocarbyl amines or may be predominantly hydrocarbyl amines in which the hydrocarbyl group includes other groups, e.g., hydroxy groups, alkoxy groups, amide groups, nitriles, imidazoline groups, and the like. Particularly useful amine compounds include mono- and polyamines, e.g., polyalkene and polyoxyalkylene polyamines of about 2 to 60, such as 2 to 40 (e.g., 3 to 20) total carbon atoms having about 1 to 12, such as 3 to 12, preferably 3 to 9, most preferably form about 6 to about 7 nitrogen atoms per molecule. Mixtures of amine compounds may advantageously be used, such as those prepared by reaction of alkylene dihalide with ammonia. Preferred amines are aliphatic saturated amines, including, for example, 1,2-diaminoethane; 1,3-diaminopropane; 1,4-diaminobutane; 1,6-diaminohexane; polyethylene amines such as diethylene triamine; triethylene tetramine; tetraethylene pentamine; and polypropyleneamines such as 1,2-propylene diamine; and di-(1,2-propylene)triamine. Such polyamine mixtures, known as PAM, are commercially available. Particularly preferred polyamine mixtures are mixtures derived by distilling the light ends from PAM products. The resulting mixtures, known as "heavy" PAM, or HPAM, are also commercially available. The properties and attributes of both PAM and/or HPAM are described, for example, in U.S. Pat. Nos. 4,938,881; 4,927,551; 5,230,714; 5,241,003; 5,565,128; 5,756,431; 5,792,730; and 5,854,186.

Other useful amine compounds include: alicyclic diamines such as 1,4-di(aminomethyl)cyclohexane and heterocyclic nitrogen compounds such as imidazolines. Another useful class of amines is the polyamido and related amido-amines as disclosed in U.S. Pat. Nos. 4,857,217; 4,956,107; 4,963,275; and 5,229,022. Also usable is tris(hydroxymethyl)amino methane (TAM) as described in U.S. Pat. Nos. 4,102,798; 4,113,639; 4,116,876; and UK 989,409. Dendrimers, star-like amines, and comb-structured amines may also be used. Similarly, one may use condensed amines, as described in U.S. Pat. No. 5,053,152. The functionalized polymer is reacted with the amine compound using conventional techniques as described, for example, in U.S. Pat. Nos. 4,234,435 and 5,229,022, as well as in EP-A-208,560.

A preferred dispersant composition is one comprising at least one polyalkenyl succinimide, which is the reaction product of a polyalkenyl substituted succinic anhydride (e.g., PIBSA) and a polyamine (PAM) that has a coupling ratio of from about 0.65 to about 1.25, preferably from about 0.8 to about 1.1, most preferably from about 0.9 to about 1. In the context of this disclosure, "coupling ratio" may be defined as a ratio of the number of succinyl groups in the PIBSA to the number of primary amine groups in the polyamine reactant.

Another class of high molecular weight ashless dispersants comprises Mannich base condensation products. Generally, these products are prepared by condensing about one mole of a long chain alkyl-substituted mono- or polyhydroxy benzene with about 1 to 2.5 moles of carbonyl compound(s) (e.g., formaldehyde and paraformaldehyde) and about 0.5 to 2 moles of polyalkylene polyamine, as disclosed, for example, in U.S. Pat. No. 3,442,808. Such Mannich base condensation products may include a polymer product of a metallocene catalyzed polymerization as a substituent on the benzene group, or may be reacted with a compound containing such a polymer substituted on a succinic anhydride in a manner similar to that described in U.S. Pat. No. 3,442,808. Examples of functionalized and/or derivatized olefin polymers synthesized using metallocene catalyst systems are described in the publications identified supra.

The dispersant(s) of the present invention are preferably non-polymeric (e.g., are mono- or bis-succinimides).

The dispersant(s) of the present invention, particularly the lower molecular weight dispersants, may optionally be borated. Such dispersants can be borated by conventional means, as generally taught in U.S. Pat. Nos. 3,087,936, 3,254,025 and 5,430,105. Boration of the dispersant is readily accomplished by treating an acyl nitrogen-containing dispersant with a boron compound such as boron oxide, boron halide boron acids, and esters of boron acids, in an amount sufficient to provide from about 0.1 to about 20 atomic proportions of boron for each mole of acylated nitrogen composition. Preferably, lubricating oil compositions of the present invention contain less than 400 ppm of boron, such as less than 300 ppm of boron, more preferably, less than 100 ppm, such as less than 70 ppm of boron (measured as atoms of boron). In one preferred embodiment, the lubricating oil compositions of the present invention are substantially free (e.g., contain less than 70 ppm) of boron, and more preferably are free of boron.

Dispersants derived from highly reactive polyisobutylene have been found to provide lubricating oil compositions with a wear credit relative to a corresponding dispersant derived from conventional polyisobutylene. This wear credit is of particular importance in lubricants containing reduced levels of ash-containing antiwear agents, such as ZDDP. Thus, in one preferred embodiment, at least one dispersant used in the lubricating oil compositions of the present invention is derived from highly reactive polyisobutylene.

Additional additives may be incorporated into the compositions of the invention to enable particular performance requirements to be met. Examples of additives which may be included in the lubricating oil compositions of the present invention are metal rust inhibitors, viscosity index improvers, corrosion inhibitors, oxidation inhibitors, friction modifiers, anti-foaming agents, anti-wear agents and pour point depressants. Some are discussed in further detail below.

Friction modifiers and fuel economy agents that are compatible with the other ingredients of the final oil may also be included. Examples of such materials include glyceryl monoesters of higher fatty acids, for example, glyceryl monooleate; esters of long chain polycarboxylic acids with diols, for example, the butane diol ester of a dimerized unsaturated fatty acid; oxazoline compounds; and alkoxylated alkyl-substituted mono-amines, diamines and alkyl ether amines, for example, ethoxylated tallow amine and ethoxylated tallow ether amine.

Other known friction modifiers comprise oil-soluble organo-molybdenum compounds. Such organo-molybdenum friction modifiers also provide antioxidant and antiwear credits to a lubricating oil composition. Examples of such oil soluble organo-molybdenum compounds include dithiocarbamates, dithiophosphates, dithiophosphinates, xanthates, thioxanthates, sulfides, and the like, and mixtures thereof. Particularly preferred are molybdenum dithiocarbamates, dialkyldithiophosphates, alkyl xanthates and alkylthioxanthates.

Additionally, the molybdenum compound may be an acidic molybdenum compound. These compounds will react with a basic nitrogen compound as measured by ASTM test D-664 or D-2896 titration procedure and are typically hexavalent. Included are molybdic acid, ammonium molybdate, sodium molybdate, potassium molybdate, and other alkaline metal molybdates and other molybdenum salts, e.g., hydrogen sodium molybdate, $MoOCl_4$, $MoO_2Br_2$, $Mo_2O_3Cl_6$, molybdenum trioxide or similar acidic molybdenum compounds.

Among the molybdenum compounds useful in the compositions of this invention are organo-molybdenum compounds of the formula $$Mo(ROCS_2)_4 \text{ and}$$

$$Mo(RSCS_2)_4$$

wherein R is an organo group selected from the group consisting of alkyl, aryl, aralkyl and alkoxyalkyl, generally of from 1 to 30 carbon atoms, and preferably 2 to 12 carbon atoms and most preferably alkyl of 2 to 12 carbon atoms. Especially preferred are the dialkyldithiocarbamates of molybdenum.

Another group of organo-molybdenum compounds useful in the lubricating compositions of this invention are trinuclear molybdenum compounds, especially those of the formula $Mo_3S_kL_nQ_z$ and mixtures thereof wherein the L are independently selected ligands having organo groups with a sufficient number of carbon atoms to render the compound soluble or dispersible in the oil, n is from 1 to 4, k varies from 4 through 7, Q is selected from the group of neutral electron donating compounds such as water, amines, alcohols, phosphines, and ethers, and z ranges from 0 to 5 and includes non-stoichiometric values. At least 21 total carbon atoms should be present among all the ligand organo groups, such as at least 25, at least 30, or at least 35 carbon atoms.

The molybdenum compounds described above, in addition to providing friction-reducing properties, also provide antiwear credits and, therefore, molybdenum compounds have been used in lubricating oil compositions formulated with reduced amounts of ZDDP. When used in such reduced phosphorus lubricating oil compositions, molybdenum compounds have been used in amounts introducing from about 10 to about 1000 ppm, such as 10 to about 350 ppm, or 10 to about 100 ppm of molybdenum (measured as atoms of molybdenum). In one embodiment, the lubricating oil compositions are substantially free (e.g., contain less than 10 ppm) of molybdenum, and more preferably are free of molybdenum.

The viscosity index of the base stock is increased, or improved, by incorporating therein certain polymeric materials that function as viscosity modifiers (VM) or viscosity index improvers (VII). Generally, polymeric materials useful as viscosity modifiers are those having number average molecular weights (Mn) of from about 5,000 to about 250,000, preferably from about 15,000 to about 200,000, more preferably from about 20,000 to about 150,000. These viscosity modifiers can be grafted with grafting materials such as, for example, maleic anhydride, and the grafted material can be reacted with, for example, amines, amides, nitrogen-containing heterocyclic compounds or alcohol, to form multifunctional viscosity modifiers (dispersant-viscosity modifiers). Polymer molecular weight, specifically $\overline{M}_n$, can be determined by various known techniques. One convenient method is gel permeation chromatography (GPC), which additionally provides molecular weight distribution information (see W. W. Yau, J. J. Kirkland and D. D. Bly, "Modern Size Exclusion Liquid Chromatography", John Wiley and Sons, New York, 1979). Another useful method for determining molecular weight, particularly for lower molecular weight polymers, is vapor pressure osmometry (see, e.g., ASTM D3592).

One class of diblock copolymers useful as viscosity modifiers has been found to provide a wear credit relative to, for example, olefin copolymer viscosity modifiers. This wear credit is of particular importance in lubricants containing reduced levels of ash-containing antiwear agents, such as ZDDP. Thus, in one preferred embodiment, at least one viscosity modifier used in the lubricating oil compositions of the present invention is a linear diblock copolymer comprising one block derived primarily, preferably predominantly, from vinyl aromatic hydrocarbon monomer, and one block derived primarily, preferably predominantly, from diene monomer. Useful vinyl aromatic hydrocarbon monomers include those containing from 8 to about 16 carbon atoms such as aryl-substituted styrenes, alkoxy-substituted styrenes, vinyl naphthalene, alkyl-substituted vinyl naphthalenes and the like. Dienes, or diolefins, contain two double bonds, commonly located in conjugation in a 1,3 relationship. Olefins containing more than two double bonds, sometimes referred to as polyenes, are also considered within the definition of "diene" as used herein. Useful dienes include those containing from 4 to about 12 carbon atoms, preferably from 8 to about 16 carbon atoms, such as 1,3-butadiene, isoprene, piperylene, methylpentadiene, phenylbutadiene, 3,4-dimethyl-1,3-hexadiene, 4,5-diethyl-1,3-octadiene, with 1,3-butadiene and isoprene being preferred.

As used herein in connection with polymer block composition, "predominantly" means that the specified monomer or monomer type that is the principle component in that polymer block is present in an amount of at least 85% by weight of the block.

Polymers prepared with diolefins will contain ethylenic unsaturation, and such polymers are preferably hydrogenated. When the polymer is hydrogenated, the hydrogenation may be accomplished using any of the techniques known in the prior art. For example, the hydrogenation may be accomplished such that both ethylenic and aromatic unsaturation is converted (saturated) using methods such as those taught, for example, in U.S. Pat. Nos. 3,113,986 and 3,700,633 or the hydrogenation may be accomplished selectively such that a significant portion of the ethylenic unsaturation is converted while little or no aromatic unsaturation is converted as taught, for example, in U.S. Pat. Nos. 3,634,595; 3,670,054; 3,700,633 and Re 27,145. Any of these methods can also be used to hydrogenate polymers containing only ethylenic unsaturation and which are free of aromatic unsaturation.

The block copolymers may include mixtures of linear diblock polymers as disclosed above, having different molecular weights and/or different vinyl aromatic contents as well as mixtures of linear block copolymers having different molecular weights and/or different vinyl aromatic contents. The use of two or more different polymers may be preferred to a single polymer depending on the rheological properties the product is intended to impart when used to produce formulated engine oil. Examples of commercially available styrene/hydrogenated isoprene linear diblock copolymers include Infineum SV140™, Infineum SV150™ and Infineum SV160™ available from Infineum USA L.P. and Infineum UK Ltd.; Lubrizol® 7318, available from The Lubrizol Corporation; and Septon 1001™ and Septon 1020™, available from Septon Company of America (Kuraray Group). Suitable styrene/1,3-butadiene hydrogenated block copolymers are sold under the tradename Glissoviscal™ by BASF.

Pour point depressants (PPD), otherwise known as lube oil flow improvers (LOFIs) lower the temperature. Compared to VM, LOFIs generally have a lower number average molecular weight. Like VM, LOFIs can be grafted with grafting materials such as, for example, maleic anhydride, and the grafted material can be reacted with, for example, amines, amides, nitrogen-containing heterocyclic compounds or alcohol, to form multifunctional additives.

In the present invention it may be necessary to include an additive which maintains the stability of the viscosity of the blend. Thus, although polar group-containing additives achieve a suitably low viscosity in the pre-blending stage it has been observed that some compositions increase in viscosity when stored for prolonged periods. Additives which are effective in controlling this viscosity increase include the long chain hydrocarbons functionalized by reaction with mono- or dicarboxylic acids or anhydrides which are used in the preparation of the ashless dispersants as hereinbefore disclosed. In another preferred embodiment, the lubricating oil compositions of the present invention contain an effective amount of a long chain hydrocarbons functionalized by reaction with mono- or dicarboxylic acids or anhydrides.

When lubricating compositions contain one or more of the above-mentioned additives, each additive is typically blended into the base oil in an amount that enables the additive to provide its desired function. Representative effective amounts of such additives, when used in crankcase lubricants, are listed below. All the values listed are stated as mass percent active ingredient (A.I.).

| ADDITIVE | MASS % (Broad) | MASS % (Preferred) |
|---|---|---|
| Dispersant | 0.1–20 | 1–8 |
| Metal Detergents | 0.1–15 | 0.2–9 |
| Corrosion Inhibitor | 0–5 | 0–1.5 |
| Metal Dihydrocarbyl Dithiophosphate | 0.1–6 | 0.1–4 |
| Antioxidant | 0–5 | 0.01–2.5 |
| Pour Point Depressant | 0.01–5 | 0.01–1.5 |
| Antifoaming Agent | 0–5 | 0.001–0.15 |
| Supplemental Antiwear Agents | 0–1.0 | 0–0.5 |
| Friction Modifier | 0–5 | 0–1.5 |

-continued

| ADDITIVE | MASS % (Broad) | MASS % (Preferred) |
|---|---|---|
| Viscosity Modifier | 0.01–10 | 0.25–3 |
| Base stock | Balance | Balance |

Preferably, the Noack volatility of the fully formulated lubricating oil composition (oil of lubricating viscosity plus all additives) will be no greater than 20 mass %, such as no greater than 15 mass %, preferably no greater than 13 mass %.

It may be desirable, although not essential to prepare one or more additive concentrates comprising additives (concentrates sometimes being referred to as additive packages) whereby several additives can be added simultaneously to the oil to form the lubricating oil composition.

The final composition may employ from 5 to 25 mass %, preferably 5 to 22 mass %, typically 10 to 20 mass % of the concentrate, the remainder being oil of lubricating viscosity.

This invention will be further understood by reference to the following examples, wherein all parts are parts by mass, unless otherwise noted and which include preferred embodiments of the invention.

EXAMPLES

Two 15W40 grade lubricants containing base stock, dispersant, detergent, ZDDP, a combination of ashless, sulfur-free phenolic and aminic antioxidants (1.5 mass % total), viscosity modifier, pour point depressant were formulated consistent with PC-10 specifications (1.0 mass % SASH; 0.4 mass % sulfur and 0.12 mass % phosphorus). Comparative Oil 1 contained a combination of an overbased (300 BN) calcium sulfonate detergent (Detergent A); an overbased (400 BN) magnesium sulfonate detergent (Detergent B); and a neutral (150 BN) calcium phenate detergent. Inventive Oil 1 contained a combination of an overbased (400 BN) magnesium sulfonate detergent (Detergent B); and a neutral (150 BN) calcium phenate detergent (Detergent C). An identical amount of Detergent C was used in each of the Comparative Oil 1 and Inventive Oil 1. The total amount of detergent in Inventive Oil 1 and Comparative Oil 1 was identical.

Valve train wear resulting from the use of the two lubricants was measured in a Cummins ISB engine test; one of the engine tests for the PC-10 specification for HDD lubricants. The ISB engine test includes two stages. Stage 1 runs for 100 hours to produce soot in the oil. Stage 2 is a 250 hour cyclic portion, intended to produce heavy load on the engine in short bursts. At the end of the test, the valve train parts are measured for wear, reported as tappet weight loss, in milligrams.

The results achieved with Comparative Oil 1 and Inventive Oil 1 are shown in Table 2.

TABLE 2

| | Oil | |
|---|---|---|
| | Comparative Oil 1 | Inventive Oil 1 |
| Grade | 15W40 | 15W40 |
| Detergent A (mass %) | 0.750 | 0.000 |
| Detergent B (mass %) | 0.700 | 1.450 |
| Detergent C (mass %) | 1.070 | 1.070 |
| mass % Ca | 0.14 | 0.06 |
| mass % Mg | 0.06 | 0.13 |
| Tappet Weight Loss (mg.) | 186.1* | 134.7 |

*average of two tests

As shown, Inventive Oil 1, which contained magnesium detergent as the sole overbased detergent, provided improved wear performance relative to Comparative Oil 1, formulated with a combination of overbased calcium and magnesium detergents.

The disclosures of all patents, articles and other materials described herein are hereby incorporated, in their entirety, into this specification by reference. Compositions described as "comprising" a plurality of defined components are to be construed as including compositions formed by admixing the defined plurality of defined components. The principles, preferred embodiments and modes of operation of the present invention have been described in the foregoing specification. What applicants submit is their invention, however, is not to be construed as limited to the particular embodiments disclosed, since the disclosed embodiments are regarded as illustrative rather than limiting. Changes may be made by those skilled in the art without departing from the spirit of the invention.

What is claimed is:

1. A lubricating oil composition having a sulfated ash content of from about 0.7 to about 1.0 mass %, a sulfur content of no greater than 0.4 mass %, and a phosphorus content of from about 0.08 to about 0.12 mass %; and a TBN of from about 7 to about 15, said lubricating oil composition comprising, or made by admixing:

(a) a major amount of oil of lubricating viscosity;

(b) an amount of an overbased magnesium detergent having a TBN of from about 200 to about 500 mg KOH/g providing said lubricating oil composition with at least 1200 ppm of magnesium; and (c) at least 0.5 mass % of an ashless antioxidant selected from the group consisting of sulfur-free phenolic antioxidants, aminic antioxidants, and mixtures thereof;

wherein substantially all overbased detergent in said lubricating oil composition is overbased magnesium detergent and at least about 70 mass % of the total amount of metal introduced into said lubricating oil composition by detergent is introduced by overbased magnesium detergent.

2. A lubricating oil composition, as claimed in claim 1, further comprising at least one nitrogen-containing dispersant, in an amount providing said lubricating oil composition with at least 0.08 mass % of nitrogen.

3. A lubricating oil composition, as claimed in claim 1, wherein said overbased magnesium detergent is one or more overbased magnesium detergents having, or having on average, a TBN of from about 300 to about 450.

4. A lubricating oil composition, as claimed in claim 1, substantially free of boron.

5. A lubricating oil composition, as claimed in claim 4, free of boron.

6. A lubricating oil composition, as claimed in claim 1, substantially free of molybdenum.

7. A lubricating oil composition, as claimed in claim 6, free of molybdenum.

8. A lubricating oil composition, as claimed in claim 1, substantially free of boron and molybdenum.

9. A lubricating oil composition, as claimed in claim 8, free of boron and molybdenum.

10. A lubricating oil composition, as claimed in claim 1, further comprising a minor amount of at least one dispersant derived from highly reactive polyisobutylene.

11. A lubricating oil composition, as claimed in claim 1, further comprising a minor amount of a linear block copolymer comprising one block derived primarily from vinyl aromatic hydrocarbon monomer, and one block derived primarily from diene monomer.

12. A lubricating oil composition, as claimed in claim 1, wherein at least 30 mass % of said oil of lubricating viscosity is Group III base stock.

13. A compression ignited (diesel) engine lubricated with a lubricating oil composition as claimed in claim 1.

14. A compression ignited (diesel) engine, as claimed in claim 13, wherein said engine is a heavy duty diesel (HDD) engine.

15. A compression ignited (diesel) engine, as claimed in claim 14, wherein said engine is equipped with at least one of an exhaust gas recirculation (EGR) system; a catalytic converter; and a particulate trap.

16. A method for improving the wear performance of a compression ignited (diesel engine) engine, which method comprises the steps of lubricating the engine with a lubricating oil composition, as claimed in claim 1, and operating the lubricated engine.

17. The method of claim 16, wherein said engine is a heavy duty diesel (HDD) engine.

18. The method of claim 17, wherein said engine is equipped with at least one of an exhaust gas recirculation (EGR) system; a catalytic converter; and a particulate trap.

* * * * *